US011773674B2

(12) United States Patent
Al-Obaidi et al.

(10) Patent No.: US 11,773,674 B2
(45) Date of Patent: Oct. 3, 2023

(54) APPARATUS, SYSTEMS, AND METHODS FOR SEALING A WELLBORE

(71) Applicant: Saudi Arabian Oil Company, Dhahran (SA)

(72) Inventors: Ibrahim A. Al-Obaidi, Al Khobar (SA); Nawaf D. Otaibi, Al Khobar (SA); Turki M. Al Balhareth, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 49 days.

(21) Appl. No.: 17/643,234

(22) Filed: Dec. 8, 2021

(65) Prior Publication Data

US 2023/0175332 A1 Jun. 8, 2023

(51) Int. Cl.

| | |
|---|---|
| ***E21B 23/14*** | (2006.01) |
| ***E21B 33/134*** | (2006.01) |
| ***E21B 23/06*** | (2006.01) |
| ***E21B 23/00*** | (2006.01) |

(52) U.S. Cl.

CPC ..... *E21B 23/06* (2013.01); *E21B 23/001* (2020.05); *E21B 23/14* (2013.01); *E21B 33/134* (2013.01)

(58) Field of Classification Search

CPC ..... E21B 23/001; E21B 23/06; E21B 23/08; E21B 23/14; E21B 33/134

See application file for complete search history.

(56) References Cited

U.S. PATENT DOCUMENTS 5,184,676 A * 2/1993 Graham ..... E21B 23/01 166/66.4
6,112,809 A * 9/2000 Angle ..... E21B 47/26 175/45
7,036,602 B2 5/2006 Turley et al.
7,143,843 B2 * 12/2006 Doering ..... E21B 4/18 175/94

(Continued)

FOREIGN PATENT DOCUMENTS

CN 102493782 A 6/2012
CN 107965285 A * 4/2018 ..... E21B 23/06

(Continued)

OTHER PUBLICATIONS

U.S. Appl. No. 17/543,233, Al-Obaidi et al., Acid-Integrated Drill Pipe Bars To Release Stuck Pipe, filed Dec. 6, 2021, 38 pages.

(Continued)

*Primary Examiner* — Jennifer H Gay
(74) *Attorney, Agent, or Firm* — Fish & Richardson P.C.

(57) ABSTRACT

A retrievable bridge plug includes a housing that includes a slickline connector; a plurality of wheels coupled to the housing, each wheel adjustable from a retracted position within the housing to an extended position from the housing; a motor assembly within the housing and driveably coupled to the plurality of wheels; a seal coupled to the housing; and a controller configured to operate the motor assembly to move the housing through a wellbore on the plurality of wheels in the extended position in response to a particular force on the housing; and activate the seal to seal the wellbore from fluid circulation there through.

24 Claims, 8 Drawing Sheets

(56) References Cited

U.S. PATENT DOCUMENTS

| | | | | |
|---|---|---|---|---|
| 7,185,714 | B2 * | 3/2007 | Doering | E21B 23/14 175/94 |
| 7,562,710 | B2 * | 7/2009 | Buchanan | E21B 33/134 166/57 |
| 8,028,590 | B2 * | 10/2011 | Tanaka | A61H 1/0218 602/33 |
| 8,151,902 | B2 * | 4/2012 | Lynde | E21B 23/14 175/104 |
| 9,279,307 | B2 | 3/2016 | Williamson | |
| 9,410,419 | B2 * | 8/2016 | Coles | E21B 47/007 |
| 9,777,545 | B2 * | 10/2017 | Ludwig | E21B 4/006 |
| 9,874,061 | B2 * | 1/2018 | Bedrossian | G05B 19/19 |
| 10,081,998 | B2 | 9/2018 | Tunget | |
| 10,309,176 | B2 * | 6/2019 | Allmaras | E21B 23/14 |
| 10,370,943 | B2 | 8/2019 | El Nekhily et al. | |
| 10,408,013 | B2 | 9/2019 | Al-Mumen et al. | |
| 10,648,278 | B2 | 5/2020 | Al-Mumen et al. | |
| 10,815,751 | B2 | 10/2020 | Al-Mumen et al. | |
| 11,156,057 | B2 * | 10/2021 | Wensrich | E21B 33/12 |
| 11,499,386 | B2 * | 11/2022 | Lende | E21B 33/134 |
| 2005/0145415 | A1 * | 7/2005 | Doering | E21B 4/18 175/24 |
| 2006/0151212 | A1 * | 7/2006 | Doering | E21B 23/14 175/24 |
| 2008/0190612 | A1 * | 8/2008 | Buchanan | E21B 33/134 166/57 |
| 2010/0263856 | A1 * | 10/2010 | Lynde | E21B 23/14 166/241.1 |
| 2015/0075783 | A1 * | 3/2015 | Angman | E21B 47/26 166/308.1 |
| 2015/0083408 | A1 * | 3/2015 | Coles | E21B 47/00 166/250.11 |
| 2015/0167416 | A1 * | 6/2015 | Ludwig | E21B 4/006 166/385 |
| 2015/0330172 | A1 * | 11/2015 | Allmaras | E21B 23/14 166/250.01 |
| 2017/0138150 | A1 * | 5/2017 | Yencho | E21B 43/26 |
| 2018/0202269 | A1 * | 7/2018 | Wensrich | E21B 43/128 |
| 2018/0306001 | A1 * | 10/2018 | Themig | E21B 43/14 |
| 2019/0368290 | A1 | 12/2019 | Vick, Jr. et al. | |
| 2020/0183040 | A1 * | 6/2020 | van der Ende | G01V 11/002 |
| 2021/0372216 | A1 * | 12/2021 | Lende | E21B 33/13 |
| 2022/0003068 | A1 * | 1/2022 | Johansen | E21B 27/02 |
| 2022/0307342 | A1 * | 9/2022 | Krüger | E21B 33/1275 |

FOREIGN PATENT DOCUMENTS

| | | | | |
|---|---|---|---|---|
| CN | 112211586 | A * | 1/2021 | |
| EP | 3553273 | A1 * | 10/2019 | E21B 23/06 |
| GB | 2530551 | A * | 3/2016 | E21B 23/01 |
| NO | 338407 | B1 * | 8/2016 | |
| WO | WO-2008091157 | A1 * | 7/2008 | E21B 23/14 |
| WO | WO-2017029621 | A1 * | 2/2017 | E21B 23/00 |
| WO | WO-2018200402 | A1 * | 11/2018 | E21B 23/06 |

OTHER PUBLICATIONS

U.S. Appl. No. 17/643,340, Al-Obaidi et al., Controlling Fluids in a Wellbore Using a Backup Packer, filed Dec. 8, 2021, 48 pages.

* cited by examiner

APPARATUS, SYSTEMS, AND METHODS FOR SEALING A WELLBORE

TECHNICAL FIELD

The present disclosure describes apparatus, systems, and methods for sealing a wellbore and, more particularly, sealing a wellbore with a bridge plug.

BACKGROUND

In hydrocarbon production operations, running and setting a wellbore seal, such as a plug, is one of many securement methods and is a conventional practice. There are different types and sizes of wellbore seals. Some types of wellbore seals can be retrievable from the wellbore once run into the wellbore on a separate downhole tractor on a wireline.

SUMMARY

In an example implementation, a downhole tool includes a tool body that includes a connector configured to couple to a downhole conveyance insertable into a wellbore formed from a terranean surface toward a subterranean formation; at least one set of wheels mounted to the tool body and adjustable between a retracted position at least partially within the tool body and an extended position to contact a wellbore tubular within the wellbore; a motor assembly coupled to the at least one set of wheels and configured to drive the at least one set of wheels in the extended position; a wellbore seal coupled to the tool body and configured to activate to contact the wellbore tubular; and a controller communicably coupled to the motor assembly and the wellbore seal and configured to perform operations that include determining that a value of a force acting on the tool body exceeds a threshold value; based on the determination, operating the motor assembly to drive the at least one set of wheels to move the tool body through the wellbore tubular independently of the downhole conveyance to the particular depth in the wellbore; and activating the wellbore seal at the particular depth to contact the wellbore tubular.

An aspect combinable with the example implementation further includes at least one sensor configured to measure the force and communicate the value of the force to the controller.

In another aspect combinable with any of the previous aspects, the force includes at least one of a drag force or a slack.

In another aspect combinable with any of the previous aspects, the controller is configured to perform operations including determining that a combination of the drag force and the slack acting on the tool body exceeds the threshold value.

In another aspect combinable with any of the previous aspects, the controller is configured to perform operations including determining that the particular depth is equal to a pre-programmed wellbore depth.

In another aspect combinable with any of the previous aspects, the controller is configured to perform operations including: determining that the tool body is at the pre-programmed depth; and stopping operation of the motor assembly at the pre-programmed depth to stop movement of the tool body at the pre-programmed depth.

In another aspect combinable with any of the previous aspects, the downhole conveyance includes a slickline.

In another aspect combinable with any of the previous aspects, the at least one set of wheels includes an uphole set of wheels that includes at least two uphole wheels, with each uphole wheel radially offset from another uphole wheel by 180°; and a downhole set of wheels that includes at least two downhole wheels, with each downhole wheel radially offset from another downhole wheel by 180° and radially offset from each uphole wheel by 90°.

In another example implementation, a method includes running a downhole tool into a wellbore on a downhole conveyance, the downhole tool including a tool body that includes a connector coupled to the downhole conveyance, the wellbore formed from a terranean surface toward a subterranean formation. The downhole tool further includes at least one set of wheels mounted to the tool body, a motor assembly coupled to the at least one set of wheels, and a wellbore seal coupled to the tool body. The method further includes determining, with a controller of the downhole tool, that a value of a force acting on the tool body exceeds a threshold value; based on the determination, adjusting the at least one set of wheels from a retracted position at least partially within the tool body to an extended position to contact a wellbore tubular within the wellbore; operating the motor assembly to drive the at least one set of wheels in the extended position to move the downhole tool within the wellbore tubular independently of the downhole conveyance to a particular depth in the wellbore; and activating the wellbore seal at the particular depth to contact the wellbore tubular.

An aspect combinable with the example implementation further includes measuring the force with at least one sensor coupled to the tool body; and communicating the value of the force to the controller.

In another aspect combinable with any of the previous aspects, the force includes at least one of a drag force or a slack.

Another aspect combinable with any of the previous aspects further includes determining, with the controller, that a combination of the drag force and the slack acting on the tool body exceeds the threshold value.

Another aspect combinable with any of the previous aspects further includes determining, with the controller, that the particular depth is equal to a pre-programmed wellbore depth.

Another aspect combinable with any of the previous aspects further includes determining, with the controller, that the tool body is at the pre-programmed depth; and stopping operation of the motor assembly with the controller at the pre-programmed depth to stop movement of the tool body at the pre-programmed depth.

In another aspect combinable with any of the previous aspects, the downhole conveyance includes a slickline.

Another aspect combinable with any of the previous aspects further includes fluidly decoupling a portion of the wellbore tubular uphole of the wellbore seal from a portion of the wellbore tubular downhole of the wellbore seal based on activating the wellbore seal to contact the wellbore tubular.

Another aspect combinable with any of the previous aspects further includes subsequent to activating the wellbore seal, decoupling the downhole conveyance from the tool body; and running the downhole conveyance out of the wellbore.

In another example implementation, a retrievable bridge plug includes a housing that includes a slickline connector; a plurality of wheels coupled to the housing, each wheel adjustable from a retracted position within the housing to an extended position from the housing; a motor assembly within the housing and driveably coupled to the plurality of wheels; a seal coupled to the housing; and a controller configured to operate the motor assembly to move the housing through a wellbore on the plurality of wheels in the extended position in response to a particular force on the housing; and activate the seal to seal the wellbore from fluid circulation there through.

In an aspect combinable with the example implementation, the motor assembly is operable to move the housing through the wellbore on the plurality of wheels in the extended position independently of a slickline connected to the housing through the slickline connector.

Another aspect combinable with any of the previous aspects further includes at least one sensor coupled to the housing and configured to measure the particular force.

In another aspect combinable with any of the previous aspects, the controller is configured to compare the particular force against a stored value, and operate the motor assembly based on the comparison.

In another aspect combinable with any of the previous aspects, the controller includes at least one memory configured to store the stored value and a value of a particular depth in the wellbore.

In another aspect combinable with any of the previous aspects, the controller is configured to determine a depth of the housing in the wellbore as the housing moves through the wellbore on the plurality of wheels in the extended position; compare the determined depth to the value of the particular depth; and based on the determined depth being equal to the value of the particular depth, stop the motor assembly to stop the housing at the particular depth in the wellbore.

In another aspect combinable with any of the previous aspects, the particular force includes a drag force.

Implementations of downhole tool systems for sealing a wellbore according to the present disclosure may include one or more of the following features. For example, downhole tool systems according to the present disclosure can provide for a retrievable bridge plug for highly deviated wells. As another example, downhole tool systems according to the present disclosure can provide for an independently moveable bridge plug that can be run into a well on a slickline conveyance, rather than wireline. As a further example, downhole tool systems according to the present disclosure can provide for an independently moveable bridge plug without the need for a wireline tractor or other secondary motive device.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
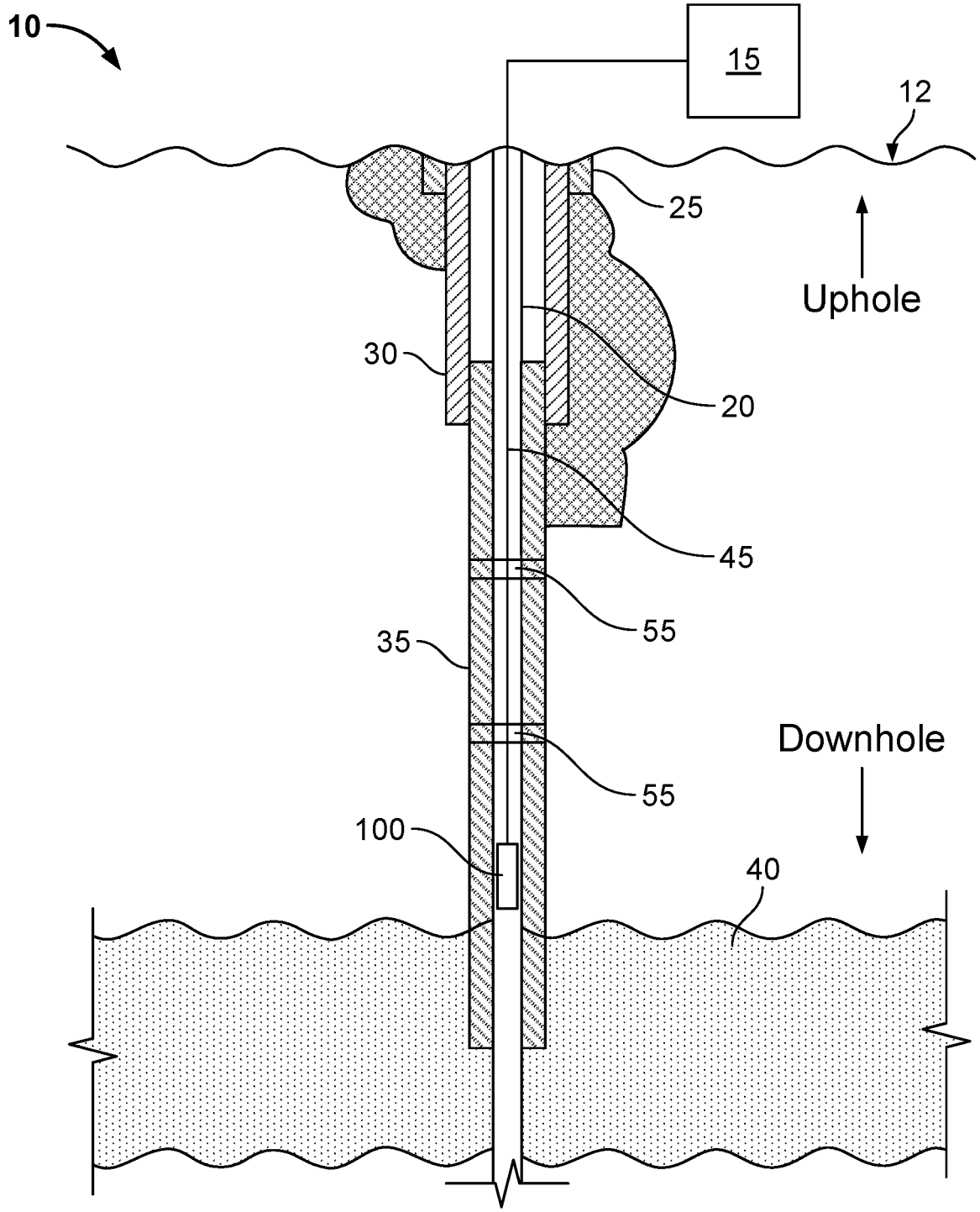
FIG. 1 is a schematic diagram of a wellbore system that includes an example implementation of a downhole tool for sealing a wellbore according to the present disclosure.

FIG. 1 is a schematic diagram of wellbore system 10 that includes a downhole tool 100 according to the present disclosure. Generally, FIG. 1 illustrates a portion of one embodiment of a wellbore system 10 according to the present disclosure in which the downhole tool 100, as a wellbore sealing tool (for example, a bridge plug) can be run into a wellbore 20 and activated at a particular location within a wellbore tubular installed in the wellbore 20 to seal the wellbore 20 (and the wellbore tubular). In this example, the downhole tool 100 is connected to a downhole conveyance 45 (for example, wireline, slickline, coiled tubing, or other conveyance) during a run in and run out operation in the wellbore 20. The downhole conveyance 45 can be, in this example, a slickline conveyance ("slickline") 45 that is coupled to a slickline conveyance system 15 (shown schematically in FIG. 1). Thus, in this example, the slickline 45 is comprised of a thin, nonelectric cable that can be used for selective placement and retrieval of the downhole tool 100 in the wellbore 20.

According to the present disclosure, the downhole tool 100 can be run into the wellbore 20 in order to seal the wellbore 20 (or, in some cases, the wellbore tubular installed in the wellbore 20) at a particular depth or position in the wellbore 20. In this example implementation, the downhole tool 100 is a retrievable bridge plug 100 that can be activated at the particular depth or position in the wellbore 20 (for example, automatically). In some aspects, the retrievable bridge plug 100 is run into the wellbore 20 on the slickline 45 and can move independently within the wellbore 20 on one or more wheels or rollers to position itself (while connected to the slickline 45) at the particular depth or position. Upon reaching the particular depth or position, the retrievable bridge plug 100 can be activated in order to seal the wellbore 20 (or, in some cases, the wellbore tubular installed in the wellbore 20) as described more fully in the present disclosure.

As shown, the wellbore system 10 accesses the subterranean formation 40 and provides access to hydrocarbons located in such subterranean formation 40. In an example implementation of system 10, the system 10 may be used for a production operation in which the hydrocarbons may be produced from the subterranean formation 40 within a wellbore tubular (for example, through the production casing 35 or other production tubular).

A drilling assembly (not shown) may be used to form the wellbore 20 extending from the terranean surface 12 and through one or more geological formations in the Earth. One or more subterranean formations, such as subterranean formation 40, are located under the terranean surface 12. As will be explained in more detail below, one or more wellbore casings, such as a surface casing 30 and production casing 35, may be installed in at least a portion of the wellbore 20. In some embodiments, a drilling assembly used to form the wellbore 20 may be deployed on a body of water rather than the terranean surface 12. For instance, in some embodiments, the terranean surface 12 may be an ocean, gulf, sea, or any other body of water under which hydrocarbon-bearing formations may be found. In short, reference to the terranean surface 12 includes both land and water surfaces and contemplates forming and developing one or more wellbore systems 10 from either or both locations.

In some embodiments of the wellbore system 10, the wellbore 20 may be cased with one or more casings. As illustrated, the wellbore 20 includes a conductor casing 25, which extends from the terranean surface 12 shortly into the Earth. A portion of the wellbore 20 enclosed by the conductor casing 25 may be a large diameter borehole. Additionally, in some embodiments, the wellbore 20 may be offset from vertical, such as deviated (for example, a slant wellbore). Even further, in some embodiments, the wellbore 20 may be a stepped wellbore, such that a portion is drilled vertically downward and then curved to a substantially horizontal wellbore portion. Additional substantially vertical and horizontal wellbore portions may be added according to, for example, the type of terranean surface 12, the depth of one or more target subterranean formations, the depth of one or more productive subterranean formations, or other criteria.

Downhole of the conductor casing 25 may be the surface casing 30. The surface casing 30 may enclose a slightly smaller borehole and protect the wellbore 20 from intrusion of, for example, freshwater aquifers located near the terranean surface 12. The wellbore 20 may than extend vertically downward. This portion of the wellbore 20 may be enclosed by the production casing 35. Any of the illustrated casings, as well as other casings or tubulars that may be present in the wellbore system 10, may include one or more casing collars 55. In the example implementation of wellbore system 10, the production casing 35 and casing collars 55 (as well as other tubular casings) can be made of steel.

The illustrated slickline conveyance system 15 can be located at the terranean surface 12 and operate to play out or pull in lengths of the slickline 45, such as when the retrievable bridge plug 100 moves into the wellbore 20 or out of the wellbore 20. In some aspects, the slickline conveyance system 15, in combination with the slickline 45, can connect and disconnect to the retrievable bridge plug 100.

Figure 2:
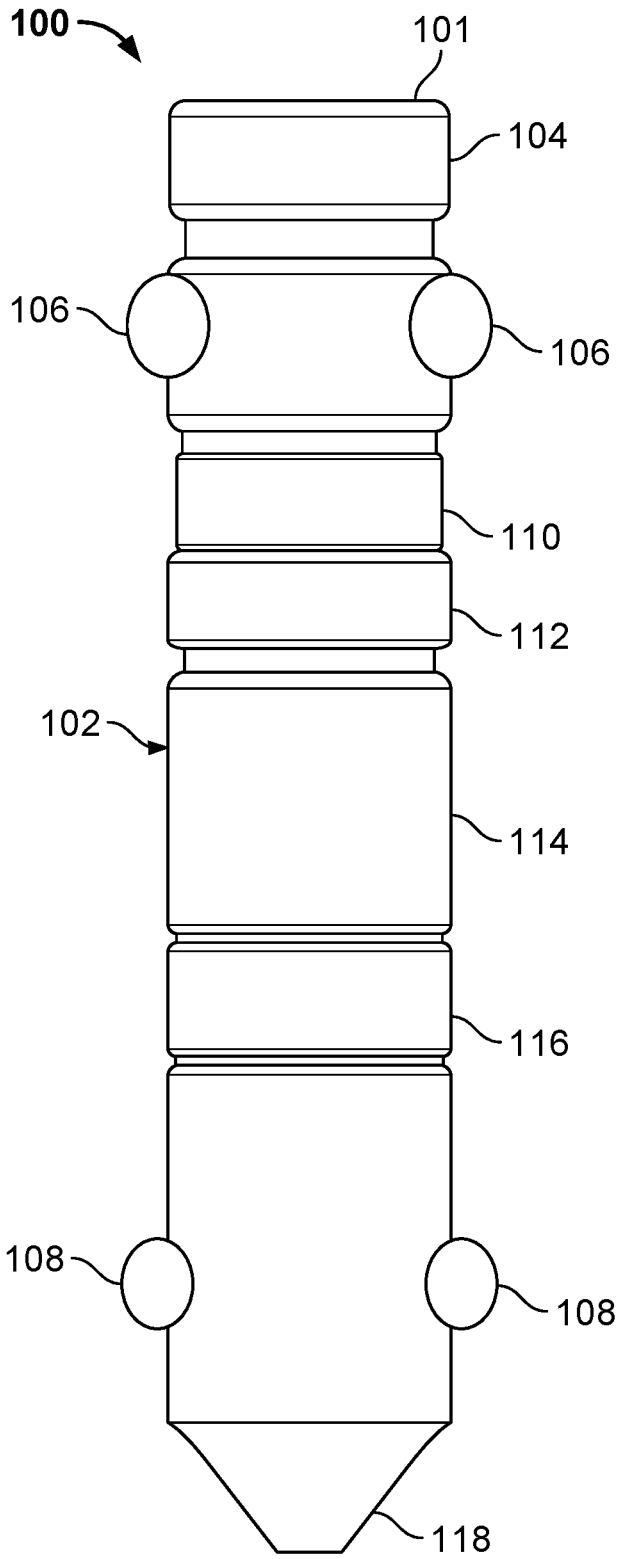
FIG. 2 is a schematic diagram of an example implementation of a downhole tool for sealing a wellbore according to the present disclosure.

FIG. 2 is a schematic diagram of an example implementation of the downhole tool 100 according to the present disclosure. As shown in this example, the downhole tool 100, as the retrievable bridge plug 100, includes multiple components that, in various implementations, can be positioned and constructed in various positional combinations of the tool 100. In this particular example implementation, the retrievable bridge plug 100 includes a tool body 102 that, at an uphole end, includes a slickline connection 101. At a downhole end of the retrievable bridge plug 100, the tool body 102 includes a nose assembly 118. In some aspects, the nose assembly 118 can include a connector assembly, for example, from which other downhole tools can be connected if so desired.

In this example implementation, the retrievable bridge plug 100 also includes a set of one or more uphole wheels (or rollers) 106 and a set of one or more downhole wheels (or rollers) 108. In some aspects, each set of wheels 106 and 108 includes at least two wheels 106 and wheels 108, with one of the wheels 106 and 108 spaced 180° radially apart on the tool body 102 from the other of wheels 106 and 108. Further, in some aspects, the wheels 108 can be spaced 90° apart from the wheels 106 on the tool body 102.

In this example implementation, one, some, or all of the wheels 106 and wheels 108 are moveable between a retracted position and an extended position. In a retracted position (for example, shown in FIG. 5A), the wheels 106 and 108 can be withdrawn within the tool body 102 so as not to create (or to minimize) contact interference between the wheels 106 and 108 and, for example, the wellbore 20 or one or more wellbore tubulars (such as production casing 35) within the wellbore 20 during a run in or run out operation on the slickline 45. In an extended position (for example, shown in FIG. 5B), the wheels 106 and 108 can be extended (for example, by a motor assembly 114 or other component of the tool) from the tool body 102 to contact the wellbore 20 or one or more wellbore tubulars (such as production casing 35) within the wellbore 20 during a run in or run out operation on the slickline 45, or simply during movement of the retrievable bridge plug 100 in the production casing 35. In some aspects, transition between the retracted position and the extended position can be controlled by a controller 112 of the retrievable bridge plug 100 based on, for example, a depth or position of the retrievable bridge plug 100 in the wellbore 20 (as explained in more detail herein).

The illustrated example of the retrievable bridge plug 100 also includes a wellbore seal 110. The wellbore seal 110, in this example, can be activated to expand or otherwise move to contact the wellbore 20 (or a wellbore tubular within the wellbore 20). In contact with the wellbore 20 (or the wellbore tubular such as the production casing 35), the activated wellbore seal 110 can fluidly separate a portion of the wellbore 20 that is uphole of the activated wellbore seal 110 from a portion of the wellbore 20 that is downhole of the activated wellbore seal 110. In some aspects, the wellbore seal 110 can be activated, deactivated (in other words, disengage from contact with the wellbore 20 or wellbore tubular), and be re-activated as desired. In some aspects, activation or deactivation can be controlled by the controller 112 of the retrievable bridge plug 100 based on, for example, a depth or position of the retrievable bridge plug 100 in the wellbore 20. In some aspects, the wellbore seal 110 can include one or more grips or teeth formed on an outer radial surface of the seal 110 to contactingly engage a wellbore tubular against movement of the seal 110, once activated.

As noted, the illustrated example of the retrievable bridge plug 100 also includes the controller 112, which is communicably coupled to, for example, the wheels 106 and 108 and the wellbore seal 110. In this example, the controller 112 comprises a micro-processor based control system that includes, for instance, one or more hardware processors and one or more tangible, non-transitory memory modules that stored instructions executable by the one or more hardware processors. In some examples, such instructions can be pre-programmed (for example, prior to the retrievable bridge plug 100 being run into the wellbore 20) to control operation of the retrievable bridge plug 100 while in the wellbore 20.

The illustrated example of the retrievable bridge plug 100 also includes a motor assembly 114 that is communicably coupled to the controller 112. The motor assembly 114, in this example, can be operated (for example, by the controller 112) to provide motive power to the wheels 106 and 108 to move the retrievable bridge plug 100 through the wellbore 20 (for example, while the wheels 106 and 108 are in contact with a wellbore tubular, such as the production casing 35). In some aspects, the motor assembly 114 can provide motive power to each wheel (or set of wheels) of the retrievable bridge plug 100 independently; alternatively, the motor assembly 114 can provide motive power to all of the wheels of the retrievable bridge plug 100 collectively.

In this example, the motor assembly 114 comprises an electric motor to which electric power can be provided by a power source 116. The power source 116 can be one or more batteries, a flywheel or fluid-based power source (for example, to generate power from movement of a wellbore fluid in the wellbore 20), other power source (rechargeable or not), or a combination of such sources. As shown in this example, the power source 116 can provide electric power to operate the motor assembly 114, as well as the controller 112, while the retrievable bridge plug 100 is moving or stationary in the wellbore 20.

The illustrated example of the retrievable bridge plug 100 also includes a sensor assembly 104 that is communicably coupled to the controller 112 and, in some aspects, the power source 116 (to receive electric power there from). In some aspects, the sensor assembly 104 includes one or more sensors configured to detect or measure, for example, a force or change in force (or forces) that act on the retrievable bridge plug 100 during movement of the plug 100 in the wellbore 20. For example, one or more sensors can detect or measure a change in a force due to a weight of the retrievable bridge plug 100 in the wellbore 20. One or more sensors can detect or measure a change in a force due to drag on the retrievable bridge plug 100 in the wellbore 20 (for example, as it moves uphole or downhole). The sensor assembly 104 can provide the sensed or measured force(s) or change of force(s) to the controller 112. The controller 112 can then control one or more other components of the retrievable bridge plug 100 based at least in part on the sensed or measured force(s) or change of force(s), either as absolute or relative values or as part of calculated values.

Figure 3:
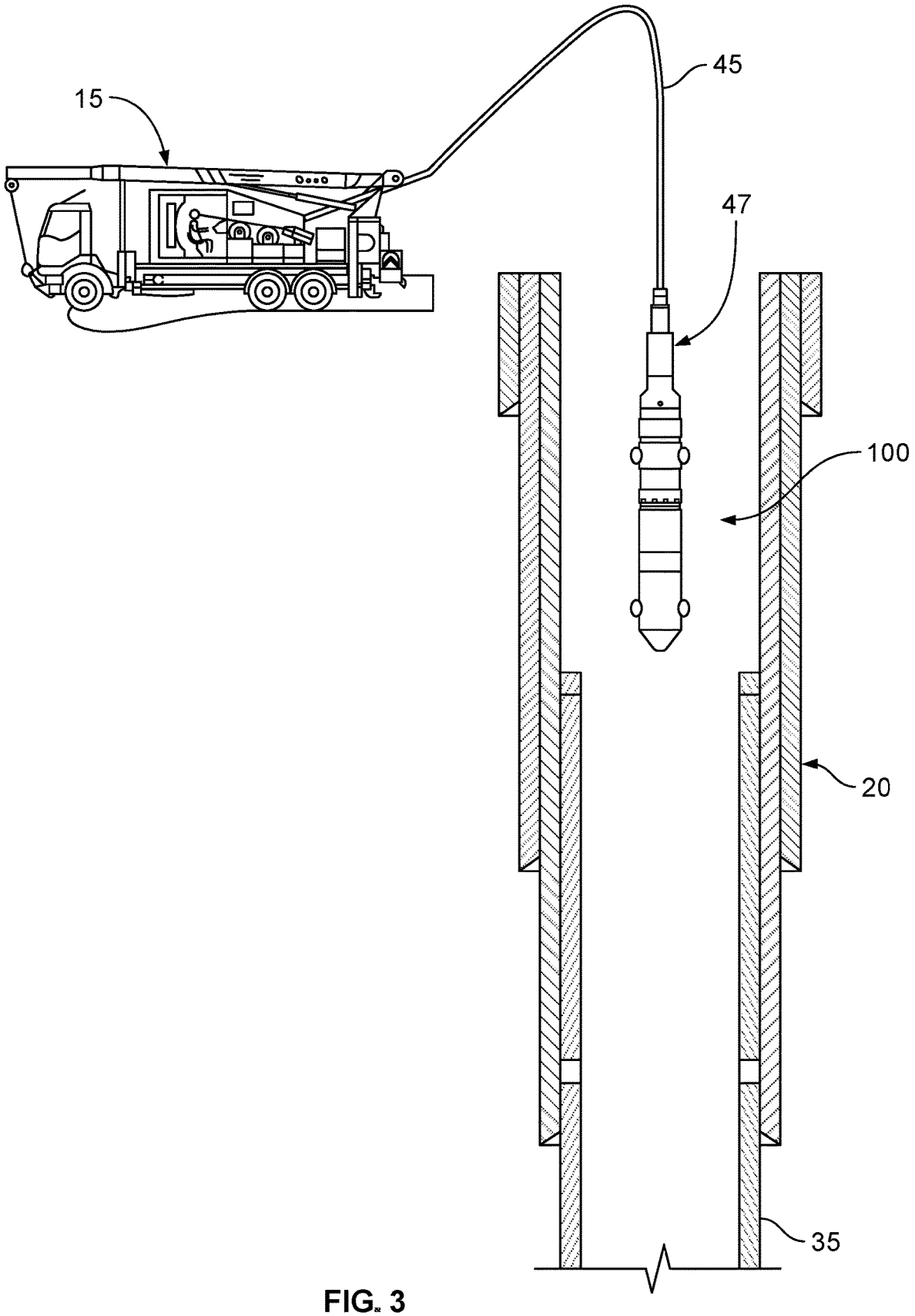
FIG. 3 illustrates the example implementation of the downhole tool of FIG. 2 within a wellbore according to the present disclosure.

FIG. 3 illustrates the example implementation of the downhole tool 100 of FIG. 2 within a wellbore according to the present disclosure. For example, as shown in FIG. 3, the downhole tool 100 (as an retrievable bridge plug 100) is connected to the slickline 45 with a slickline connector 47, which is configured to couple to or release from the slickline connection 101 of the retrievable bridge plug 100. In this example, the retrievable bridge plug 100 is shown with wheels in an extended position; however, during an initial run in process on the slickline 45, the wheels (106 and 108) of the retrievable bridge plug 100 are typically in the retracted position. For instance, as the retrievable bridge plug 100 is initially run into wellbore 20, the operation of moving the retrievable bridge plug 100 into and through the wellbore 20 (and one or more wellbore tubulars) on the slickline 45 can be similar to conventional slickline running procedures. In this example implementation, the slickline conveyance system 15 is a slickline unit truck 15 that can be used to deploy the retrievable bridge plug 100 on the slickline 45.

Figure 4:
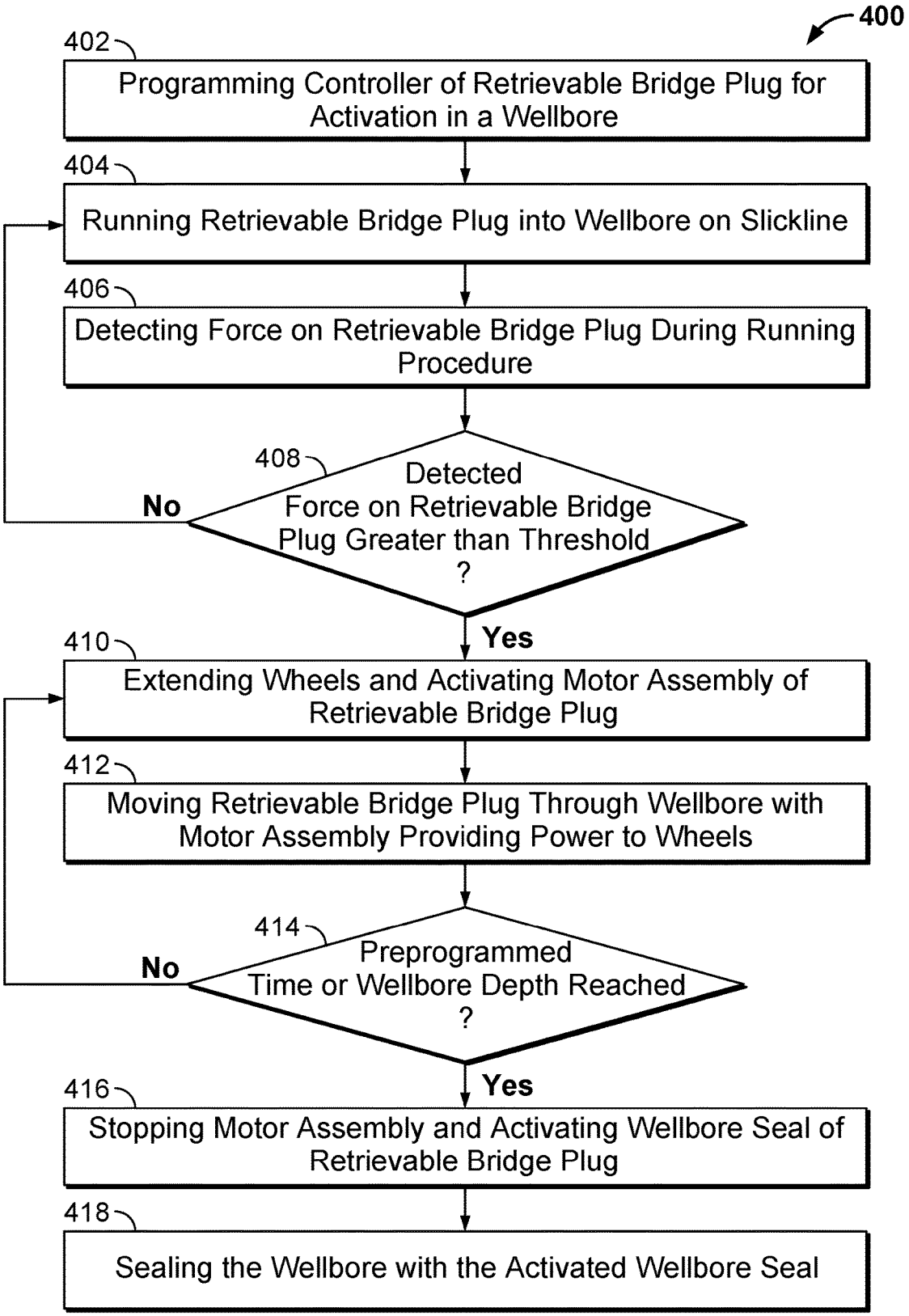
FIG. 4 is a flowchart that describes an example process for sealing a wellbore with a downhole tool according to the present disclosure.

FIG. 4 is a flowchart that describes an example process 400 for sealing a wellbore with a downhole tool according to the present disclosure. In some aspects, process 400 can be implemented with the downhole tool 100 as a retrievable bridge plug 100. Process 400 can begin at step 402, which includes programming controller of a retrievable bridge plug for activation in a wellbore. For example, the controller 112 can be programmed prior to the retrievable bridge plug 100 being, for example, connected to the slickline 45 or prior to the retrievable bridge plug 100 being initially run into the wellbore 20. In some aspects, the controller 112 can be programmed to activate the retrievable bridge plug 100, such as activate the wellbore seal 110, at a particular depth in the wellbore 20. In another example, the controller 112 can be programmed to activate the retrievable bridge plug 100, such as activate the wellbore seal 110, at a particular three-dimensional location within the wellbore 20. As another example, the controller 112 can be programmed to activate the retrievable bridge plug 100, such as activate the wellbore seal 110, at a particular time from which the retrievable bridge plug 100 was first run into the wellbore 20. In some aspects, one, some or all of such particular activation parameters can be programmed into the controller 112.

Process 400 can continue at step 404, which includes running the retrievable bridge plug into the wellbore on a slickline. For example, once the controller 112 has been programmed, the retrievable bridge plug can be connected to the slickline 45, or if previously connected, run into the wellbore 20 by the slickline conveyance system 15. In some aspects, in step 404 (and previously to step 404), the wheels 106 and 108 of the retrievable bridge plug 100 are in retracted positions within the tool body 102 of the retrievable bridge plug 100. Thus, in some aspects, the step of 404 occurs in a conventional fashion, with the retrievable bridge plug 100 being moved into and through the wellbore 20 solely or substantially by the slickline 45.

Figure 5A:
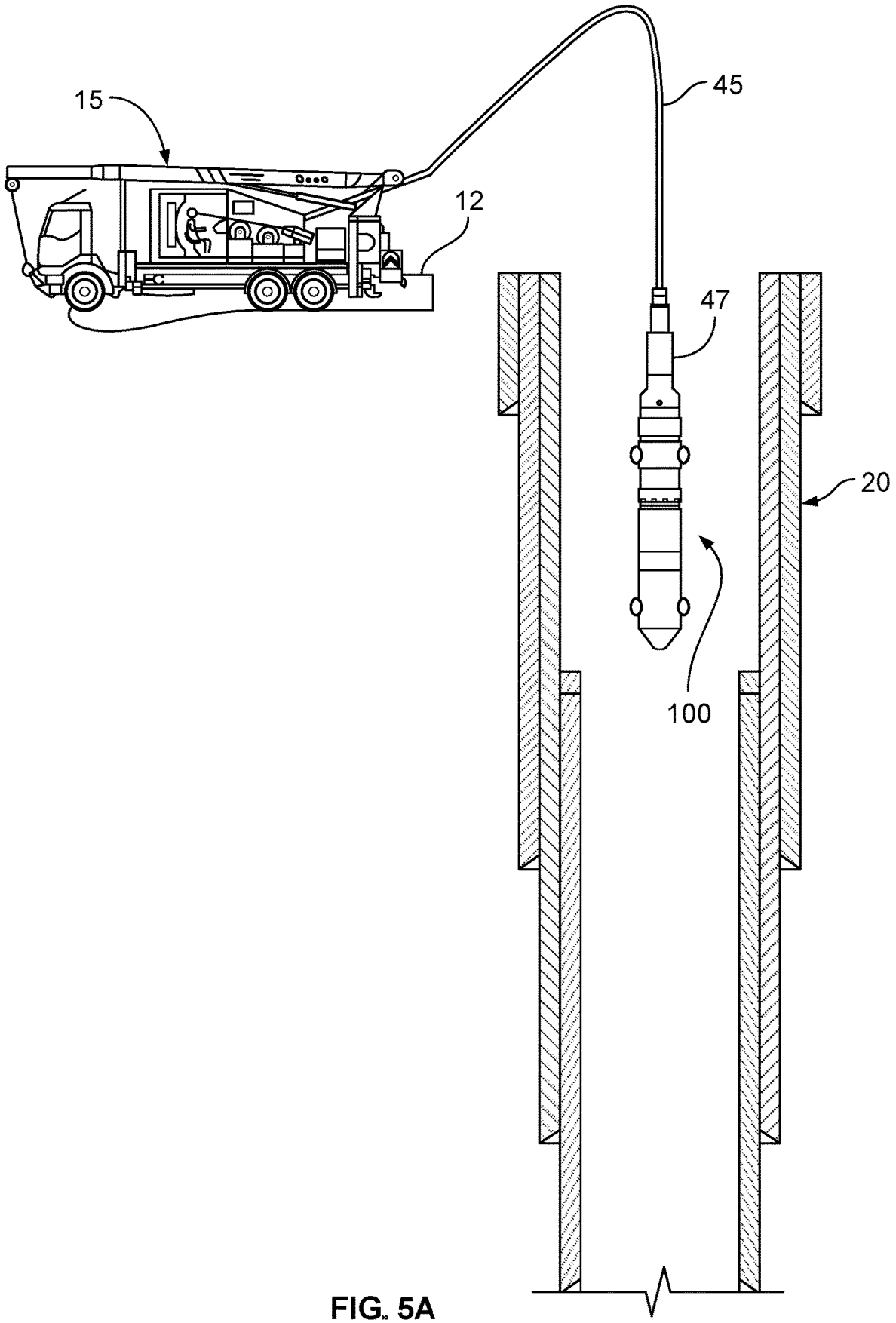
FIGS. 5A-5C are schematic illustrations of an example implementation of a downhole tool during an operation for sealing a wellbore according to the present disclosure.

Turning briefly to FIG. 5A, this figure shows a schematic illustration of the retrievable bridge plug 100 during step 404. As shown, the slickline unit truck 15 deploys the slickline 45, which is connected to the retrievable bridge plug 100. As described, the wheels 106 and 108 are retracted in step 404 and in FIG. 5A, as the retrievable bridge plug 100 is run into the wellbore 20 (and through one or more wellbore tubulars, such as surface casings, conductor casings, and intermediate casings).

Process 400 can continue at step 406, which includes detecting a force (or forces) on the retrievable bridge plug during the running procedure. For example, as the retrievable bridge plug 100 is run into the wellbore 20 (during step 404), one or more forces may act on the retrievable bridge plug 100. For example, a force that can act (individually or in combination with other forces) on the retrievable bridge plug 100 can include a weight of the tool 100 itself (in other words, a force determined by the weight and acceleration due to gravity). The weight of the tool 100 can create an opposite tension in the slickline 45, which can be sensed by the sensor assembly 104, the slickline unit truck 15, or both. Another force that can act (individually or in combination with other forces) on the retrievable bridge plug 100 can include a drag force, in which the retrievable bridge plug 100 contacts a wall of a wellbore tubular in the wellbore 20. The drag force (or friction force), generally acts in an opposite direction as the weight of the tool 100 and further, can cause slack in the slickline 45 to increase. The drag force on the tool 100 (and corresponding slack, if any) can be sensed by the sensor assembly 104, the slickline unit truck 15, or both.

Process 400 can continue at step 408, which includes a determination of whether the detected force (or forces) on the retrievable bridge plug is greater than a threshold. For example, in some aspects, especially when the retrievable bridge plug 100 has reached a deviated (for example, curved, slanted, angled) portion of the wellbore 20, the drag force can increase. In highly deviated wellbores, the drag force (and corresponding slack) on the retrievable bridge plug 100 can reach or exceed a threshold value (programmed into the controller 112). The controller 112, therefore, can determine in step 406 whether or not the sensed drag force and corresponding slack (as measured by the sensor assembly 104, for instance) has reached the threshold value.

If the determination by the controller 112 is "no" in step 408, then the retrievable bridge plug 100 can continue to be run into the wellbore 20 on the slickline 45 in step 404. If the determination by the controller 112 is "yes" in step 408, then process 400 can continue at step 410, which includes extending one or more sets of wheels and activating a motor assembly of the retrievable bridge plug. For example, once the threshold value of drag (or combination of drag and slack) is met as determined by the controller 112, then the controller 112 can activate the motor assembly 114 to extend the wheels 106 and 108 (or activate the motor assembly 114 and activate the wheels 106 and 108 to extend). By extending the wheels 106 and 108, the retrievable bridge plug 100 can be in contacting engagement with, for example, the production casing 35 in order to move independently (of the slickline 45).

Figure 5B:
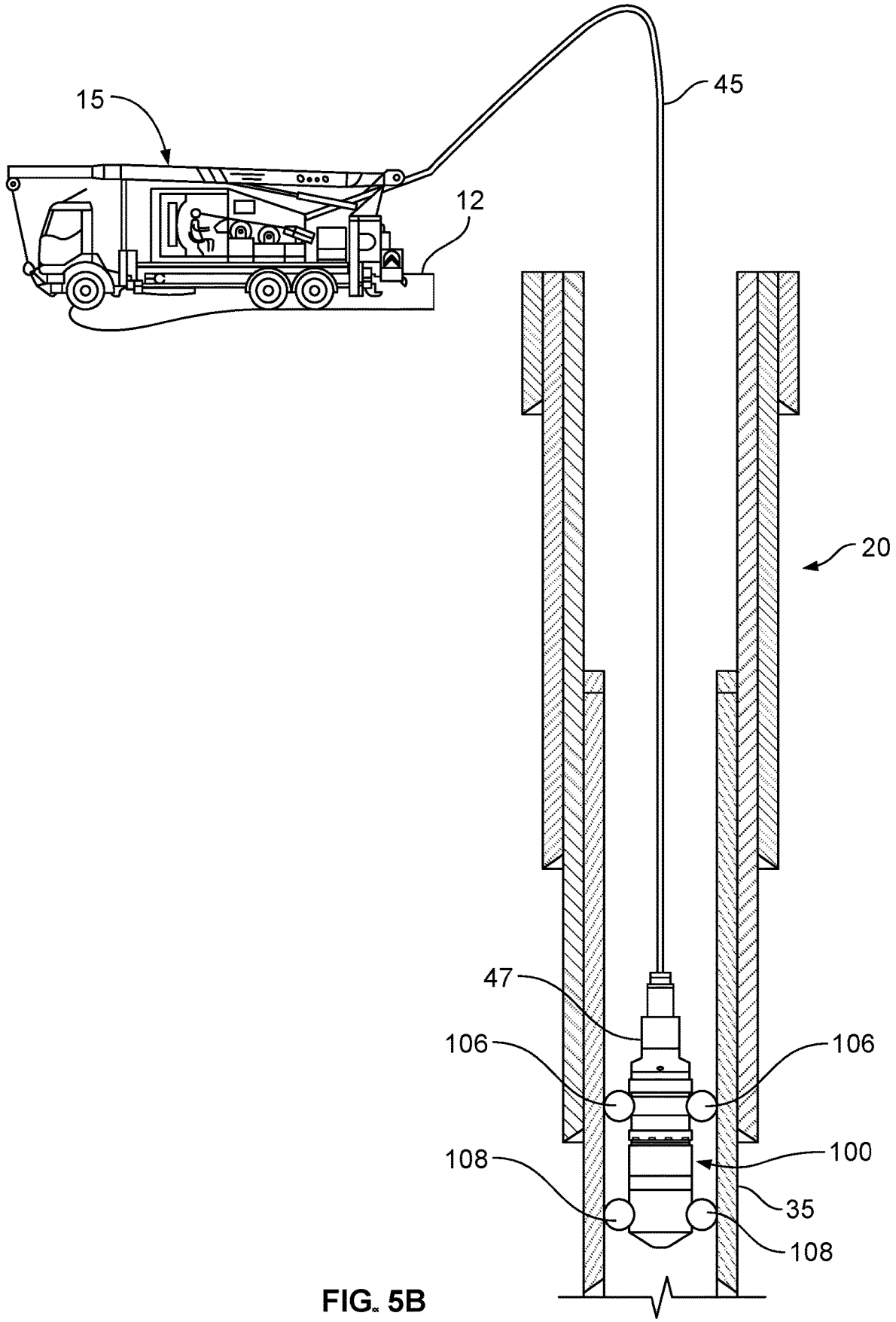

Turning briefly to FIG. 5B, this figure shows a schematic illustration of the retrievable bridge plug 100 during step 410. As shown, the retrievable bridge plug 100 has wheels 106 and 108 in the extended position to contact the production casing 35. FIG. 5B can also represent the retrievable bridge plug 100 as it independently moves through the production casing 35 (described in the next step).

Process 400 can continue at step 412, which includes moving the retrievable bridge plug through the wellbore with the motor assembly providing power to the one or more sets of wheels. For example, the controller 112 can operate the motor assembly 114 to drive wheels 106 and 108 (with power source 116) to move the retrievable bridge plug 100 through the production casing 35 at a constant or variable speed. In some aspects, once the retrievable bridge plug 100 is moving independently through the production casing 35, the slickline conveyance truck 15 does not further assist the retrievable bridge plug 100 in its movement (in other words, the slickline 45 is just deployed as the retrievable bridge plug 100 moves).

Process 400 can continue at step 414, which includes a determination of whether a preprogrammed time or wellbore depth is reached by the retrievable bridge plug. For example, in some aspects, the controller 112 determines if the programmed activation parameter (or parameters) from step 402 have been met during movement of the retrievable bridge plug 100 in the production casing. In some aspects, that parameter is wellbore depth, such as a plug setting depth in the wellbore 20. In some aspects, that parameter is running time of the retrievable bridge plug 100 in the wellbore. In some aspects, a combination of depth and time can be used as the pre-programmed activation parameter by the controller 112. If the determination by the controller 112 in step 414 is "no," then the process 400 continues at 412, and the retrievable bridge plug continues to move through the wellbore with the motor assembly providing power to the one or more sets of wheels.

If the determination by the controller 112 in step 414 is "yes," then process 400 can continue at step 416, which includes stopping the motor assembly and activating a wellbore seal of the retrievable bridge plug. For example, if the parameter is wellbore depth, once the retrievable bridge plug 100 has reached a preprogrammed depth as determined by the controller 112, then the controller 112 stops the motor assembly 114, which in turns stops movement of the wheels 106 and 108 (and, in some aspects, the wheels 106 and 108 are returned to the retracted position by the controller 112). The retrievable bridge plug 100 can then come to a stop in the wellbore 20 at the pre-programmed depth. Once stopped, the controller 112 can activate the wellbore seal 110 (for example, to expand and engage the production casing 35) to seal the wellbore 20.

Figure 5C:
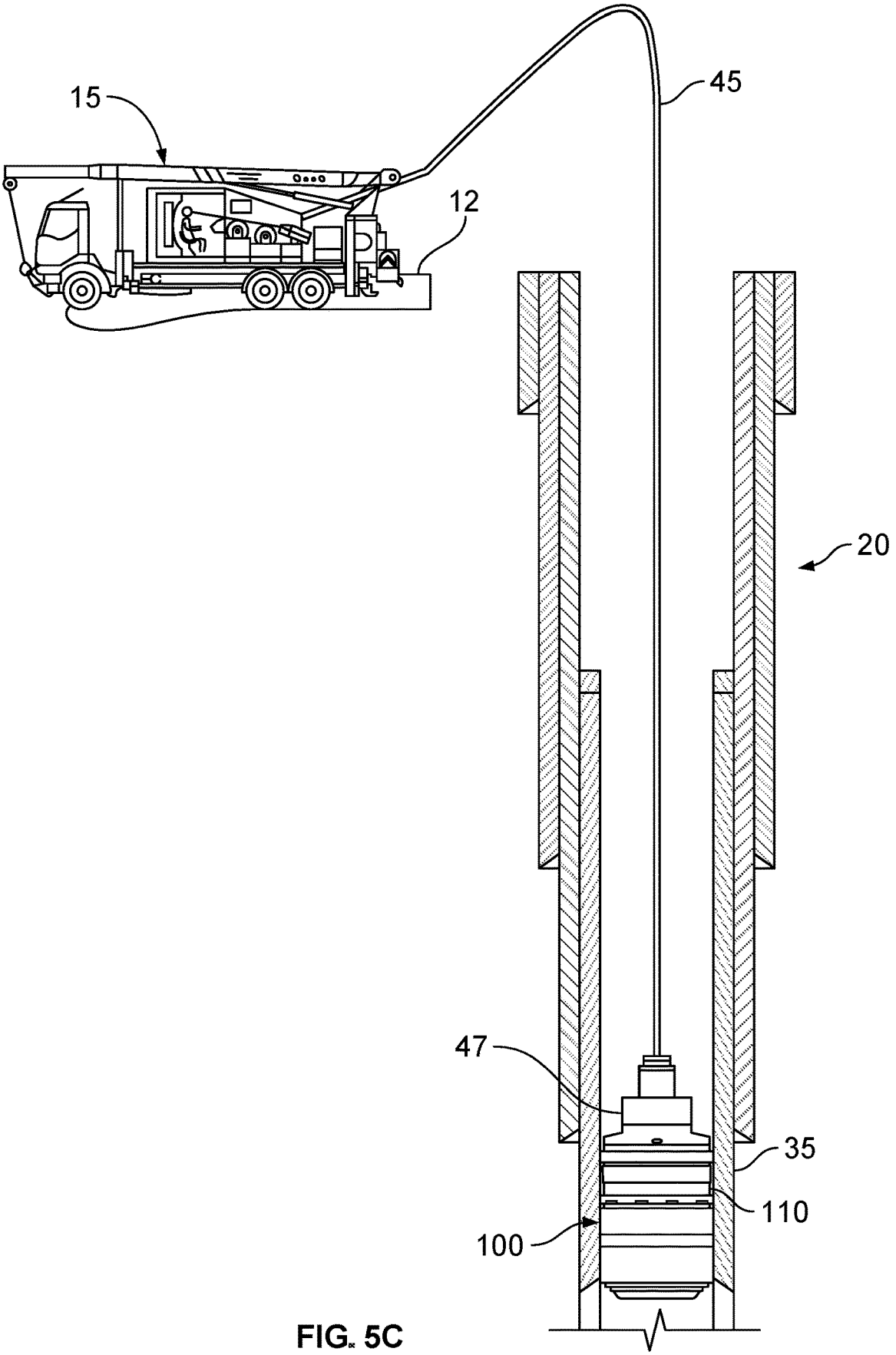

Process 400 can continue at step 418, which includes sealing the wellbore with the activated wellbore seal. For example, FIG. 5C shows a schematic illustration of the retrievable bridge plug 100 during step 418. As shown, the retrievable bridge plug 100 has been activated such that the wellbore seal 110 expands to engage with the production casing 35. Once engaged, a portion of the production casing 35 that is uphole of the retrievable bridge plug 100 is fluidly decoupled from a portion of the production casing 35 that is downhole of the retrievable bridge plug 100.

Process 400 can include other steps as well. For example, in some aspects, a "yes" determination in step 408 may not occur, such as when the retrievable bridge plug 100 is run into a vertical wellbore or a near-vertical wellbore. In such cases, process 400 may progress from step 404 to step 414 while skipping steps 406-412. The retrievable bridge plug 100 would then be run conventionally on the slickline 45 and activated at the pre-programmed depth and/or time.

As another example, process 400 can including confirming the activation of the retrievable bridge plug 100 by releasing the slickline connector 47 from the retrievable bridge plug 100 and pulling out the slickline 45 from the wellbore 20. In some aspects, process 400 can also include deactivating and retrieving the retrievable bridge plug 100 subsequent to step 418. For example, the slickline connector 47 can be run back into the wellbore 20 to connect to the retrievable bridge plug 100, which is then deactivated to release the wellbore seal 110 from the production casing 35. The retrievable bridge plug 100 can then be run out of the wellbore 200 on the slickline 45.

As another example, subsequent to step 418, process 400 can include checking the retrievable bridge plug 100 to make sure it is properly set. For example, once activated to seal the wellbore 20 (or production casing 35), slack will occur on the slickline 45. By removing or reducing the slack in the slickline 45, the slickline conveyance system 15 can determine if the retrievable bridge plug 100 is properly set (in other words, not moving in the production casing 35).

Figure 6:
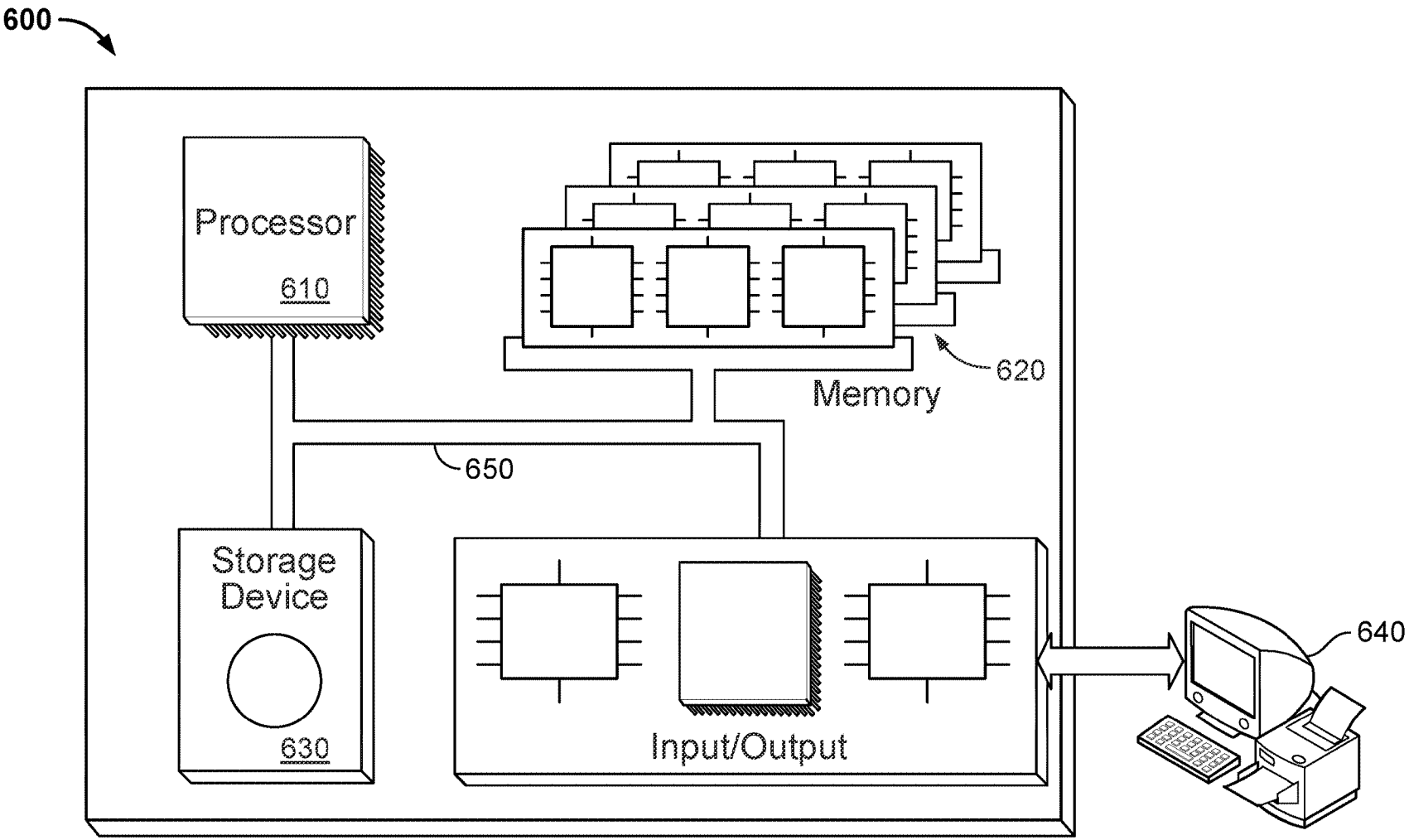
FIG. 6 is a schematic illustration of an example controller of a downhole tool for sealing a wellbore according to the present disclosure.

FIG. 6 is a schematic illustration of an example controller 600 (or control system) for a downhole tool, such as the downhole tool 100. For example, all or parts of the controller 600 can be used for the operations described previously, for example as or as part of the controller 112 of the retrievable bridge plug 100. The controller 600 is intended to include various forms of digital computers, such as printed circuit boards (PCB), processors, digital circuitry, or otherwise. Additionally, the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 600 includes a processor 610, a memory 620, a storage device 630, and an input/output device 640. Each of the components 610, 620, 630, and 640 are interconnected using a system bus 650. The processor 610 is capable of processing instructions for execution within the controller 600. The processor may be designed using any of a number of architectures. For example, the processor 610 may be a CISC (Complex Instruction Set Computers) processor, a RISC (Reduced Instruction Set Computer) processor, or a MISC (Minimal Instruction Set Computer) processor.

In one implementation, the processor 610 is a single-threaded processor. In another implementation, the processor 610 is a multi-threaded processor. The processor 610 is capable of processing instructions stored in the memory 620 or on the storage device 630 to display graphical information for a user interface on the input/output device 640.

The memory 620 stores information within the controller 600. In one implementation, the memory 620 is a computer-readable medium. In one implementation, the memory 620 is a volatile memory unit. In another implementation, the memory 620 is a non-volatile memory unit.

The storage device 630 is capable of providing mass storage for the controller 600. In one implementation, the storage device 630 is a computer-readable medium. In various different implementations, the storage device 630 may be a floppy disk device, a hard disk device, an optical disk device, a tape device, flash memory, a solid state device (SSD), or a combination thereof.

The input/output device 640 provides input/output operations for the controller 600. In one implementation, the input/output device 640 includes a keyboard and/or pointing device. In another implementation, the input/output device 640 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, solid state drives (SSDs), and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) or LED (light-emitting diode) monitor for displaying information to the user and a keyboard and a pointing device such as a mouse or a trackball by which the user can provide input to the computer. Additionally, such activities can be implemented via touchscreen flat-panel displays and other appropriate mechanisms.

The features can be implemented in a control system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include a local area network ("LAN"), a wide area network ("WAN"), peer-to-peer networks (having ad-hoc or static members), grid computing infrastructures, and the Internet.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A downhole tool, comprising:

a tool body that comprises a connector configured to couple to a downhole conveyance insertable into a wellbore formed from a terranean surface toward a subterranean formation;

at least one set of wheels mounted to the tool body and adjustable between a retracted position at least partially within the tool body and an extended position to contact a wellbore tubular within the wellbore;

a motor assembly coupled to the at least one set of wheels and configured to drive the at least one set of wheels in the extended position;

a wellbore seal coupled to the tool body and configured to activate to contact the wellbore tubular; and a controller communicably coupled to the motor assembly and the wellbore seal and configured to perform operations comprising:

determining that a value of a force acting on the tool body exceeds a threshold value;

based on the determination, operating the motor assembly to drive the at least one set of wheels to move the tool body through the wellbore tubular independently of the downhole conveyance to a particular depth in the wellbore; and activating the wellbore seal at the particular depth to contact the wellbore tubular, wherein the tool body is configured to decouple from the downhole conveyance subsequent to activating the wellbore seal at the particular depth such that the downhole conveyance can be run out of the wellbore.

2. The downhole tool of claim 1, further comprising at least one sensor configured to measure the force and communicate the value of the force to the controller.

3. The downhole tool of claim 2, wherein the force comprises at least one of a drag force or a slack.

4. The downhole tool of claim 3, wherein the controller is configured to perform operations comprising determining that a combination of the drag force and the slack acting on the tool body exceeds the threshold value.

5. The downhole tool of claim 1, wherein the controller is configured to perform operations comprising determining that the particular depth is equal to a pre-programmed wellbore depth.

6. The downhole tool of claim 5, wherein the controller is configured to perform operations comprising:

determining that the tool body is at the pre-programmed depth; and stopping operation of the motor assembly at the pre-programmed depth to stop movement of the tool body at the pre-programmed depth.

7. The downhole tool of claim 1, wherein the downhole conveyance comprises a slickline.

8. The downhole tool of claim 1, wherein the at least one set of wheels comprises:

an uphole set of wheels that comprises at least two uphole wheels, with each uphole wheel radially offset from another uphole wheel by 180°; and a downhole set of wheels that comprises at least two downhole wheels, with each downhole wheel radially offset from another downhole wheel by 180° and radially offset from each uphole wheel by 90°.

9. A method, comprising:

running a downhole tool into a wellbore on a downhole conveyance, the downhole tool comprising a tool body that comprises a connector coupled to the downhole conveyance, the wellbore formed from a terranean surface toward a subterranean formation, the downhole tool further comprising:

at least one set of wheels mounted to the tool body, a motor assembly coupled to the at least one set of wheels, and a wellbore seal coupled to the tool body;

determining, with a controller of the downhole tool, that a value of a force acting on the tool body exceeds a threshold value;

based on the determination, adjusting the at least one set of wheels from a retracted position at least partially within the tool body to an extended position to contact a wellbore tubular within the wellbore;

operating the motor assembly to drive the at least one set of wheels in the extended position to move the downhole tool within the wellbore tubular independently of the downhole conveyance to a particular depth in the wellbore;

activating the wellbore seal at the particular depth to contact the wellbore tubular;

subsequent to activating the wellbore seal, decoupling the downhole conveyance from the tool body; and running the downhole conveyance out of the wellbore.

10. The method of claim 9, further comprising:

measuring the force with at least one sensor coupled to the tool body; and communicating the value of the force to the controller.

11. The method of claim 10, wherein the force comprises at least one of a drag force or a slack.

12. The method of claim 11, further comprising determining, with the controller, that a combination of the drag force and the slack acting on the tool body exceeds the threshold value.

13. The method of claim 10, further comprising:

determining, with the controller, that the particular depth is equal to a pre-programmed wellbore depth;

determining, with the controller, that the tool body is at the pre-programmed depth;

stopping operation of the motor assembly with the controller at the pre-programmed depth to stop movement of the tool body at the pre-programmed depth; and fluidly decoupling a portion of the wellbore tubular uphole of the wellbore seal from a portion of the wellbore tubular downhole of the wellbore seal based on activating the wellbore seal to contact the wellbore tubular.

14. The method of claim 9, further comprising determining, with the controller, that the particular depth is equal to a pre-programmed wellbore depth.

15. The method of claim 14, further comprising:

determining, with the controller, that the tool body is at the pre-programmed depth; and stopping operation of the motor assembly with the controller at the pre-programmed depth to stop movement of the tool body at the pre-programmed depth.

16. The method of claim 9, wherein the downhole conveyance comprises a slickline.

17. The method of claim 9, further comprising fluidly decoupling a portion of the wellbore tubular uphole of the wellbore seal from a portion of the wellbore tubular downhole of the wellbore seal based on activating the wellbore seal to contact the wellbore tubular.

18. A retrievable bridge plug, comprising:

a housing that comprises a slickline connector;

a plurality of wheels coupled to the housing, each wheel adjustable from a retracted position within the housing to an extended position from the housing;

a motor assembly within the housing and driveably coupled to the plurality of wheels;

a seal coupled to the housing; and a controller configured to:

operate the motor assembly to move the housing through a wellbore on the plurality of wheels in the extended position in response to a particular force on the housing; and activate the seal to seal the wellbore from fluid circulation there through, wherein the housing is configured to decouple a slickline from the slickline connector subsequent to activation of the seal to seal the wellbore such that the slickline can be run out of the wellbore.

19. The retrievable bridge plug of claim 18, wherein the motor assembly is operable to move the housing through the wellbore on the plurality of wheels in the extended position independently of a slickline connected to the housing through the slickline connector.

20. The retrievable bridge plug of claim 18, further comprising at least one sensor coupled to the housing and configured to measure the particular force.

21. The retrievable bridge plug of claim 20, wherein the controller is configured to compare the particular force against a stored value, and operate the motor assembly based on the comparison.

22. The retrievable bridge plug of claim 21, wherein the controller comprises at least one memory configured to store the stored value and a value of a particular depth in the wellbore.

23. The retrievable bridge plug of claim 22, wherein the controller is configured to:

determine a depth of the housing in the wellbore as the housing moves through the wellbore on the plurality of wheels in the extended position;

compare the determined depth to the value of the particular depth; and based on the determined depth being equal to the value of the particular depth, stop the motor assembly to stop the housing at the particular depth in the wellbore.

24. The retrievable bridge plug of claim 18, wherein the particular force comprises a drag force.

* * * * *